US005528818A

United States Patent [19]

Warneke

[11] Patent Number: 5,528,818

[45] Date of Patent: Jun. 25, 1996

[54] ASSEMBLY LINE FOR PRODUCING A STEEL COFFER FROM SHEET METAL PLATE

[76] Inventor: Horst Warneke, Am Osterfeld 37, D-2807 Achim, Germany

[21] Appl. No.: 204,262

[22] PCT Filed: Jun. 26, 1993

[86] PCT No.: PCT/EP93/01640

§ 371 Date: Aug. 2, 1994

§ 102(e) Date: Aug. 2, 1994

[87] PCT Pub. No.: WO94/01234

PCT Pub. Date: Jan. 20, 1994

[30] Foreign Application Priority Data

Jul. 10, 1992 [DE] Germany ..... 42 22 741.0

[51] Int. Cl.[6] ..... B23P 23/04

[52] U.S. Cl. ..... 29/564.7; 29/564.1; 72/203; 228/5.1

[58] Field of Search ..... 29/33 R, 33 K, 29/33 D, 564.1, 564.7, 26 R, 26 A, 623.7; 72/198, 203, 205, 420, 428, 460, 323; 228/15.1, 5.1, 47

[56] References Cited

U.S. PATENT DOCUMENTS

| | | | |
|---|---|---|---|
| 4,025,371 | 5/1977 | Pecha | 29/623.2 |
| 4,106,318 | 8/1978 | Yanagimoto et al. | 72/205 |
| 4,378,688 | 4/1983 | Spanke et al. | 72/420 |
| 4,420,868 | 12/1983 | McEwen et al. | 29/460 |
| 4,467,633 | 8/1984 | McEwen et al. | 72/203 |
| 5,070,718 | 12/1991 | Thomas | 72/198 |

FOREIGN PATENT DOCUMENTS

| | | |
|---|---|---|
| 0069661 | 1/1983 | European Pat. Off. . |
| 0213667 | 11/1987 | European Pat. Off. . |
| 2613962 | 10/1988 | France . |
| 9111219 | 3/1987 | Germany . |
| 9105925 | 5/1991 | WIPO . |

OTHER PUBLICATIONS

*The Sun Also Rises In Italy,* Sheet Metal Industries, vol. 68, No. 1, pp. 25–26, Jan. 1991.

W. Bauer, *Biegemaschinen,* Werkstattstechnik, Zeitschrift Fur Industrielle Fertigung, vol. 81, No. 3, pp. 178–179, 1991.

*Primary Examiner*—William Briggs

*Attorney, Agent, or Firm*—Browdy and Neimark

[57] ABSTRACT

The assembly line for producing a steel coffer (2) for ceiling and/or wall structures, in particular for interior finishing and construction of ships, for transportable and movable buildings, for sheds, hotels and the like, from a sheet metal plate (1) comprises a cutting and/or stamping station (3), a bending press (4) with an associated manipulator (5) and an associated roller-ball table (6) and a welding station (7), as well as at least one trolley (8) in the form of an underfloor vehicle, an underfloor trolley, or the like, which can move back and forth under these stations (3, 5, 7). The bending press (4) is combined with a manipulator (5) designed as a semi-portal crane, which is movable with respect to this press (4) and has a gripper which is also movable, adjustable in height and rotatable around the height axis, by means of which the sheet metal plate (1) is fed in its required positions to the bending press (4). The bending press (4) has a hold-down device which can be swiveled to compensate various sheet metal thicknesses.

21 Claims, 6 Drawing Sheets

ASSEMBLY LINE FOR PRODUCING A STEEL COFFER FROM SHEET METAL PLATE

Figure 1:
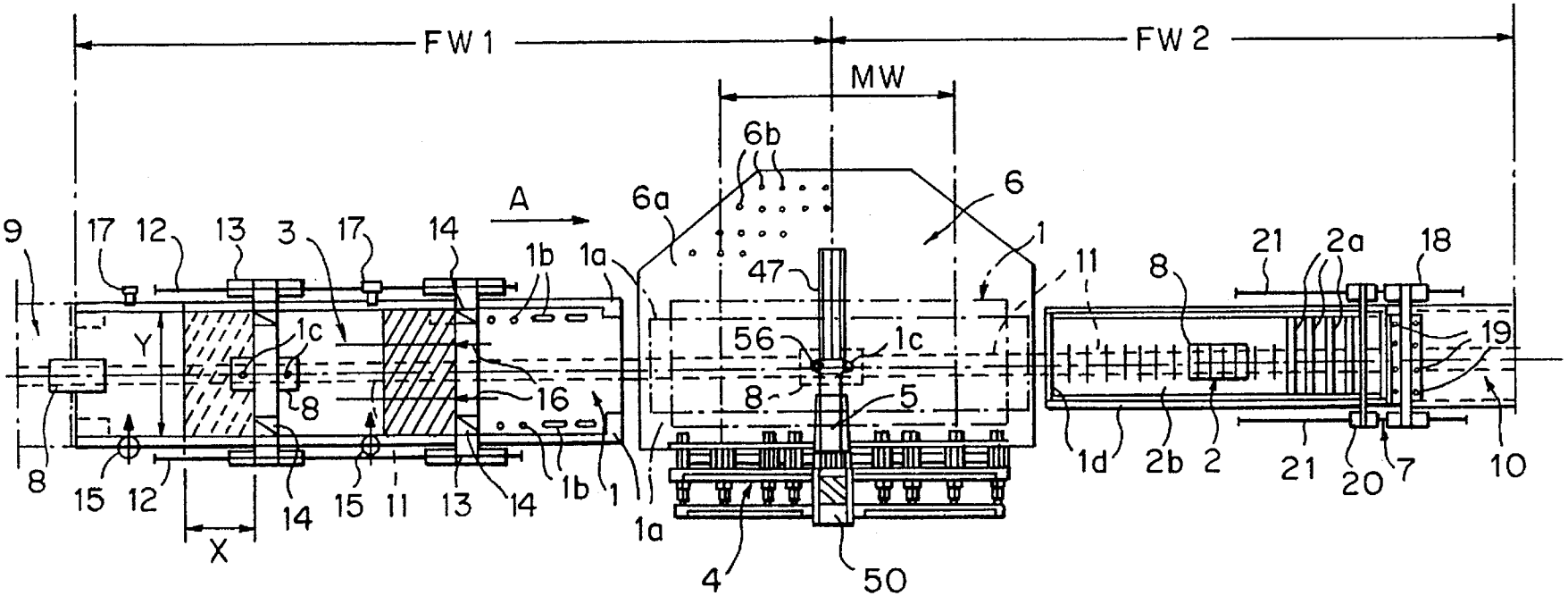

The invention relates to an assembly line (installation) by means of which it is intended to produce steel coffers as finished components for ceilings and/or wall structures at a plurality of stations in a continuous run.

A large number of steel coffers is required as wall elements and bearing floors in the course of erecting large buildings, as well as for interior finishing and construction of buildings and ships, which coffers consist of multiply beveled steel sheets of a large length and width, which are to be provided with trough-openings and fastening holes and are to have welded-on reinforcing sections.

In actuality, this coffer production is performed elaborately by means of a plurality of machines, and the known bending presses are not designed for beveling long sheets, so that the steel coffers are of only small dimensions and therefore their number used is increased and the total construction is made more expensive.

It is the object of the invention to develop an assembly line, by means of which it is possible to produce a steel coffer incorporating all required structural characteristics for later use, having a large surface and made of various sheet metal thicknesses from a sheet metal plate in the course of an automatic run-through and at manipulable processing positions with short clock times in an efficient and economical manner.

This object is attained in accordance with the invention by the characterizing features of claim 1; the subsequent dependent claims 2 to 6 contain advantageous further developments of the embodiment of the assembly line.

It is a further object of the invention to provide a bending press for beveling of long sheet metal plates of different sheet metal thicknesses at an even bending pressure and large bending angles, which can be integrated into the assembly line as a long multi-component.

This object is attained by the characteristic of claim 7 and the subsequent claims 8 to 13 containing advantageous further developments.

A further object is considered to be the provision of a manipulator cooperating with the bending press, which introduces the sheet metal plate into the bending press and removes it therefrom and has many free degrees of movement.

This object is attained by means of claims 14 to 16.

One concept of the invention is seen to lie in the entire assembly line, a second, independent concept of the invention lies in the special characteristics of the bending press, and a third concept of the invention lies in the combination of the bending press with the specially designed and operating manipulator.

By means of the assembly line of the invention it is possible to produce in an efficient and economical manner large numbers of steel coffers within short clock times (clock time 17 min.), which have all structural characteristics required for later use and a large-surface design.

The bending installation is one of several stations of the assembly line and comprises three bending presses which can be coupled, an underfloor trolley (bogey truck), a manipulator and a roller-ball table.

The bending presses, having individual lengths of 4 m and operating in accordance with the bending process, are individually controlled but designed in such a way that they can simultaneously work on the workpiece (sheet metal plate) without gaps in the manner of a battery of two or three presses.

The manipulator is embodied as a movable semi-wall crane, has a movable gripping and rotating device for the sheet metal plate and positions it in the bending press without the need for stops. Manipulation of the sheet metal plate takes place in one processing plane. The sheet metal piece or coffer is supported on the roller-ball table. The manipulator here needs only to overcome inertia and frictional resistance.

The job of the underfloor trolley, which can be moved along the X axis in an elongated gap of the roller-ball table, is to convey the sheet metal piece always into the same position and to hand it over to the manipulator, as well as to take over an already bent coffer in the same position and to convey it on to the next station.

The bending press (one or a plurality of coupled bending presses) has been optimized for bending sheet steel of approximately 4 to approximately 6 mm and with a breaking resistance of 400 $N/mm^2$.

The bending power of the press is 850 kN. The press can be put under a load of 1200 kN for short periods of time, in which case it can also be supplied with a more powerful oscillating motor.

It is possible to assign each one of the three bending presses separate individual press tables, or a common press table of 12 m length.

The bending press has a large pivot and work range of 600 mm with a free through-opening of the same size. To process a workpiece of a length of 12 m, shorter and at the same time stable press units are used in the battery of three presses.

Each press is mainly made of parts which are screwed together.

The rigid C-frame of the bending press is embodied as a welded structure and the total processing of the C-frame takes place in one chucking. The screwing surfaces for guides, oscillating motors and bearings are milled and turned.

The drive for the bending cheek is performed by two lateral double toothed quadrants. A hydraulic oscillating motor drives a torsion shaft in the center, on the ends of which pinion gears are fastened to the left and right of the C-frame.

The bending press is designed for 90° bending. The size of the bending cheek and the bending drive make pivoting around an angle of 120° possible. The bending cheek is guided in each C-frame via many support rollers with spherical running surfaces and guide rollers with eccentrics. For improved load distribution, the support rollers with their fixable eccentric shafts are appropriately resilient. Spherical running surfaces prevent loads on the edges of the rollers. The guide rollers are also resiliently mounted. They are mounted at a short distance from the guide rail, so that they are not subjected to the deformation forces of the C-frame.

The bending forces are guided via the cheek and the bending cheek body as far as the support rollers.

The C-frame has a bearing above this roller guide for the bending cheek, in which an eccentric shaft is supported. The eccentric disks are double-seated in the eccentric eye of the connecting flange.

A blocking cylinder eye has been attached on the upper part of the flange. Each one of the eye flanges is screwed together with the hold-down device.

On one side of the center eccentric eye, the shaft can be driven by a hydraulic oscillating motor via a toothed reduction gear. A pivot lever is fastened on the eccentric shaft on the other side of the center eccentric eye. The hold-down device is pivoted away in a controlled manner by the oscillating motor by means of a pivot lever. In the course of this, the oscillating motor must be assisted by the blocking cylinders.

The deformation forces of the hold-down device and the C-frame are not transmitted to the bearings.

The oscillating motor is screwed to the C-frame by means of the flange.

When bending narrow sheet metal plates, the manipulator is located in the vicinity of the hold-down device. The hold-down device then does not pivot away freely. In this case pivoting must take place controlled and coupled with the corresponding displacement of the manipulator. This control is performed by the oscillating motor via the rotation transmitter. The oscillating motor, together with the blocking cylinder causes the pivoting of the hold-down device.

First, the oscillating motor generates the hold-down force (the force between the table and the hold-down device) via the eccentric. In the course of bending, it is reduced to a defined residual clamping force. During bending the oscillating motor is under oil pressure.

The blocking cylinder is automatically locked on the piston side as soon as it has moved into the end position.

It remains locked until the hold-down device is pivoted away. The blocking cylinder has such dimensions that it can take up the hold-down reaction forces as well as the bending reaction forces.

The blocking cylinder with the eye flange, the hold-down device and the eccentric shaft with the bearings together form a coupling mechanism which is driven by the eccentric shaft. The position of the eccentric has been set in such a way that an optimal setting of the foot of the hold-down device is possible for various sheet metal thicknesses. The size of the eccentric of approximately 12 mm has been set in consideration of the necessary lift of approximately 15 mm of the hold-down device. Lifting makes the displacement, free of sliding, of the workpiece possible for follow-up bending.

A support surface for the guide rail carrier has been welded on above the blocking cylinder bearing on all C-frames of the bending machine formed by the bending presses. A surface for screwing on a guide rail carrier has also been formed at the bottom on the rear part of the C-frame. These surfaces allow the simultaneous connection of the three bending presses with the manipulator within the tolerances of processing exactness, which is of extraordinary importance for producing the coffers. The bending machine together with the manipulator constitutes a functional unit.

The job of the manipulator is to take over the sheet metal plate from the previous station, to service the bending press and to transfer the formed sheet metal plate for further processing, for example for inserting and welding transverse bows, trapezoidal sections, etc.

Manipulation of the sheet metal piece takes place in one processing plane. The sheet metal piece or coffer is supported on the roller-ball table. In the bending station, the workpiece is fed to the bending machine by the portal crane in the correct position. It is never lifted off the roller-ball table. The sheet metal piece is merely received by clamping cheeks of the manipulator via two retaining bolts welded to the sheet metal piece. These bolts are parallel to the X axis and are therefore in fixed connection with the coordinate system.

The sheet metal plate is cut and provided with holes in the laser station. It is transferred along the X axis to the manipulator exactly in the center of the roller-ball table by an underfloor trolley in the center of the transfer line. The retaining bolts are hollow.

Thus, the sheet metal piece is always moved into the same transfer position. Positioning of the manipulator can be selected to remain within rough limits, because the clamping cheeks (clamping chucks) have sufficiently large openings. For this reason the trolley guidance in this station can be selected to be relatively simple.

The construction of the crane and the manipulator and the selection of the guide elements make possible highly exact positioning, so that the tolerance range and the assembly techniques are sufficient and no positioning stops are needed on the roller-ball table and the bending machine.

The sheet metal processing technique in the preceding stations has been simplified and made less expensive because of the design without stops.

The manipulator is embodied in welded full-box construction as a semi-portal crane with a support column. This design allows a light construction.

Figure 2:
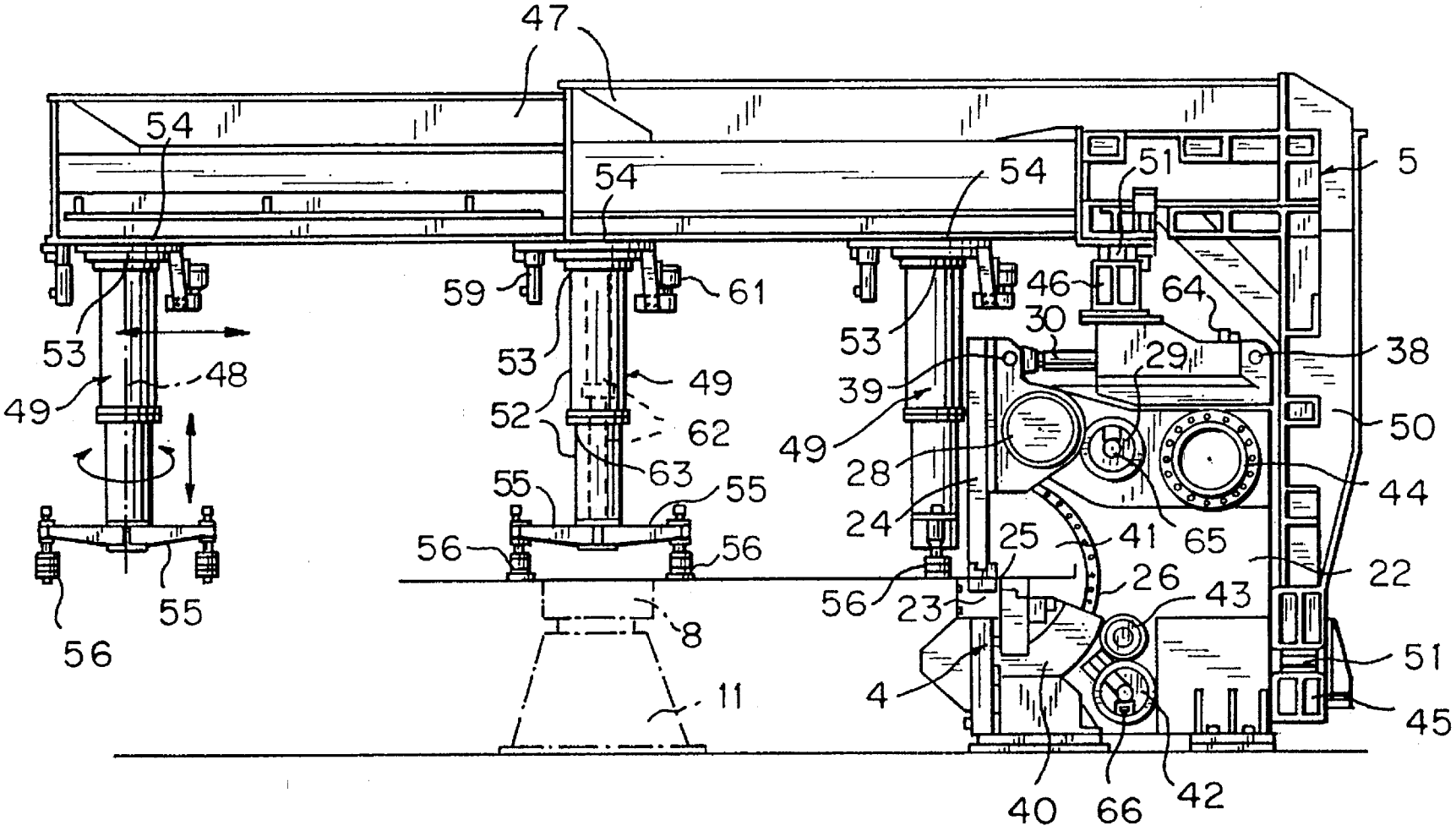
Figure 3:
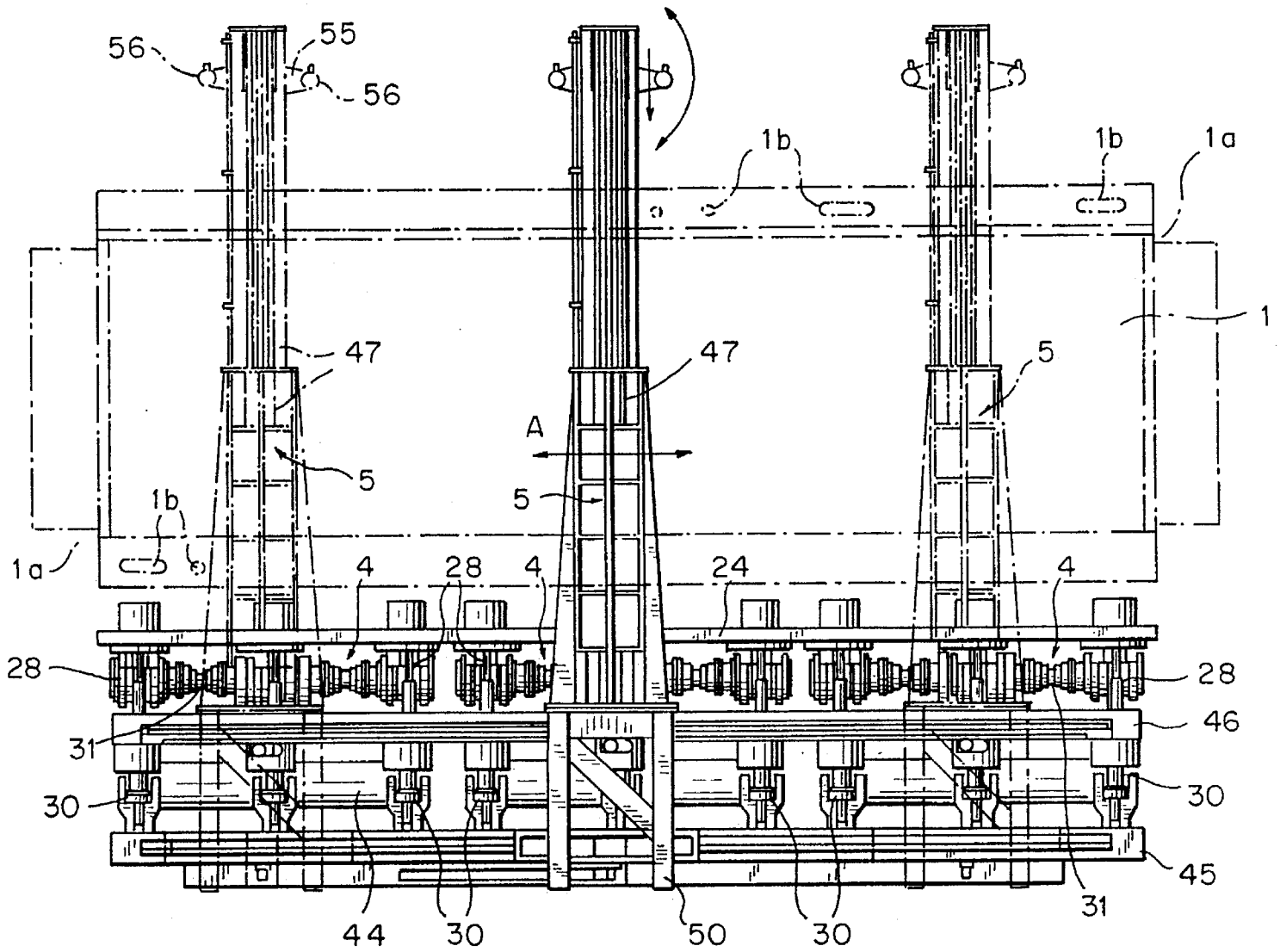
Figure 4:
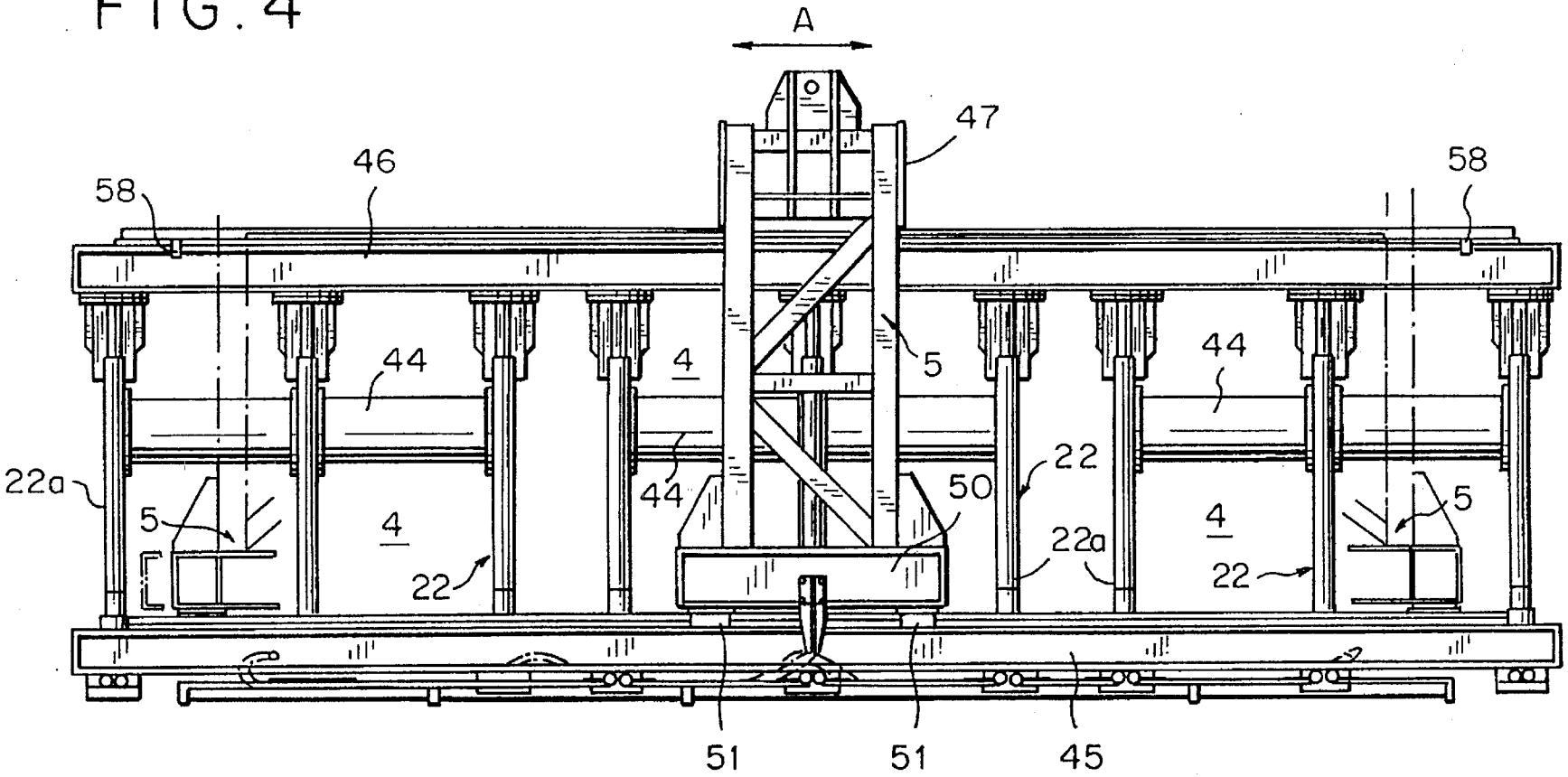
Figure 5:
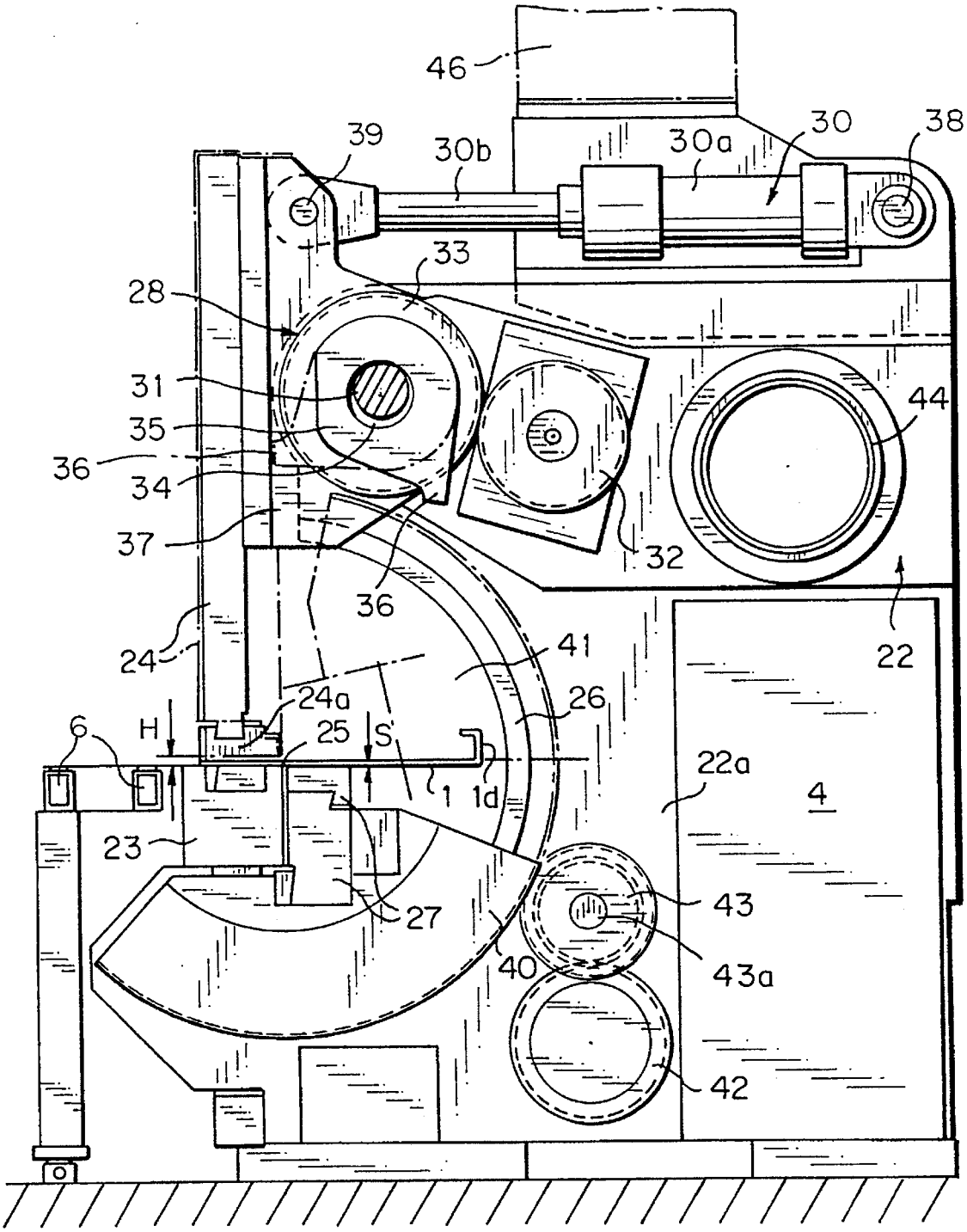
Figure 6:
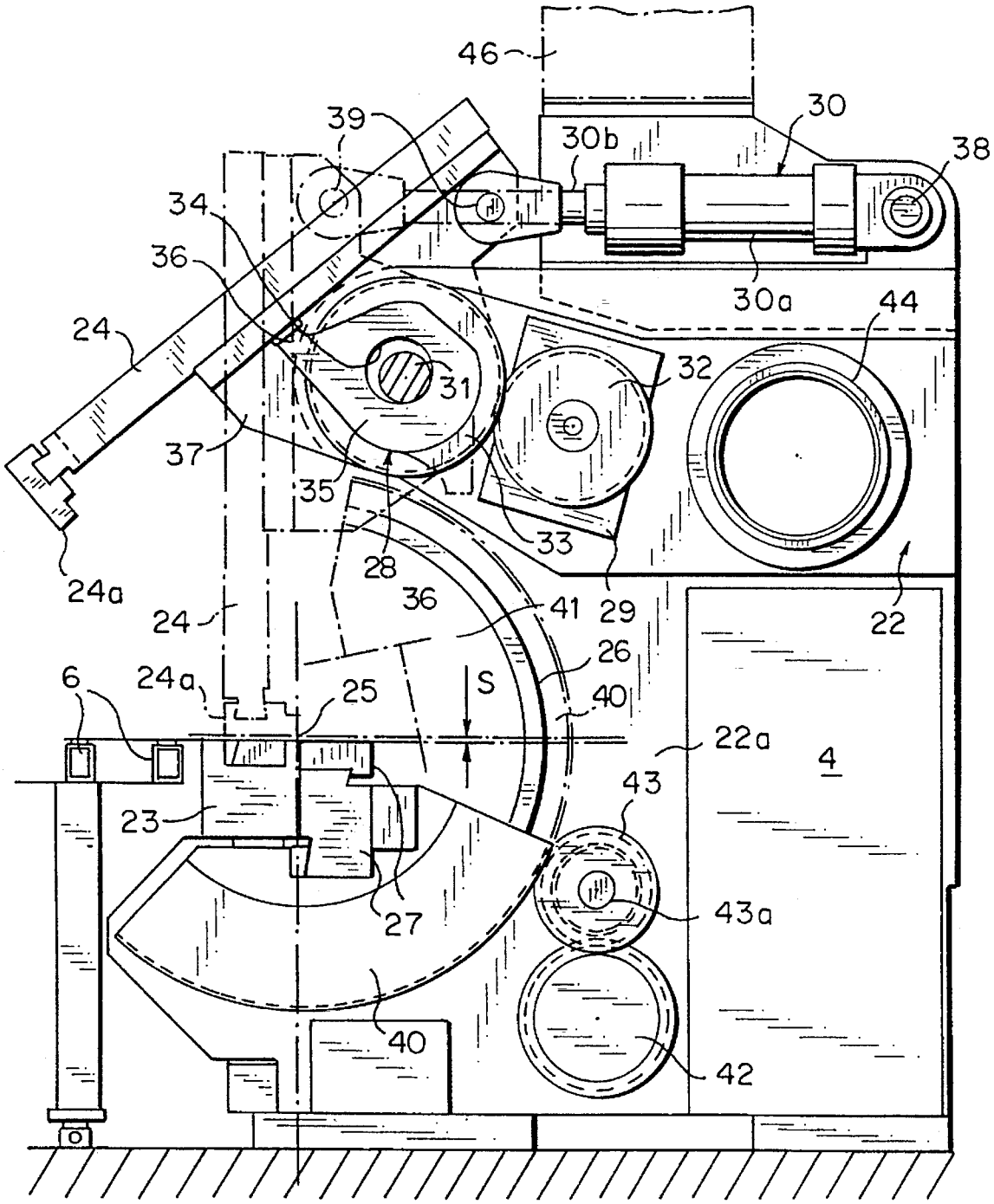

An exemplary embodiment of the invention is shown in the drawings, shown is in:

FIG. 1, a top view of an assembly line for steel coffers, consisting of a cutting and/or stamping station, a bending press with a manipulator and a roller-ball table, and a welding station, FIG. 2, a lateral view of the bending press with manipulator, FIG. 3, a top view of the bending press with manipulator, FIG. 4, a back view of the bending press with manipulator, FIG. 5, a lateral view of the bending press with the hold-down device pivoted downward into the clamping position (solid lines) and in the lifted position of the hold-down device in dash-dotted lines, FIG. 6, a lateral view of the bending press with the hold-down device pivoted up.

The assembly line for producing a steel coffer (2) for ceiling and/or wall structures, in particular for interior finishing and construction of ships, for transportable and movable buildings, for sheds, hotels and the like, from a sheet metal plate (1) comprises a cutting and/or stamping station (3), a bending press (4) with an associated manipulator (5) and an associated roller-ball table (6) and a welding station (7), as well as at least one trolley (8) in the form of an underfloor vehicle, an underfloor trolley, or the like, which can move back and forth under these stations (3, 5, 7).

A pre-treatment station (9) is disposed upstream of the cutting and/or stamping station (3), and a roller conveyor (10) is connected to the welding station (7). All stations (9, 3, 4, 2 and 10) are disposed behind each other in the pass-through direction (A) of the sheet metal plate (1) and result in a straight work run.

Notches (1*a*), openings (1*b*) and reamed holes (1*c*)—see FIG. 1—are cut into the sheet metal plate (1) at the cutting and/or stamping station (3).

The circumferential edge of the sheet metal plate (1) is formed into a singly— or multiply-beveled edge (1*d*)—see FIG. 1 in steps in the bending press (4), wherein the roller-ball table (6) is used as the support for the sheet metal plate (1) and the manipulator (5) grasps the sheet metal plate (1) at its fitting marks (1*c*), formed by the reamed holes (1*c*) and/or retaining bolts provided therein, and inserts it for the individual forming steps into the bending press (4) and takes it out of it again; in the process the sheet metal plate (1) continues to lie on the roller-ball table (6) and only its position is changed (displacement or turning) in this support plane.

Reinforcement sections (2*a*) are placed in the formed sheet metal plate (1) in the welding station (7) at distances to form a grid and are cyclically welded—see FIG. 1—, after which the steel coffer (2) is finished and is transported out of the assembly line by the roller conveyor (10).

It is preferred to dispose two trolleys (8), which can be moved on a continuous guide (11), under the stations (9, 3, 4, 6, 7 and 10), wherein the first trolley (8) operates on a movement path (FW1) starting at the pre-treatment station (9) and extending to the center of the roller-ball table (6), and thus the bending press (4), while the movement path (FW2) of the second trolley (8) extends from the center of the roller-ball table (6) into the area of the roller conveyor (10).

The trolleys (8) move the sheet metal plate (1) into the individual stations (3, 6, 7, 10) and stop there for processing of the sheet metal plate, or move on in steps.

The cutting and/or stamping station (3) has two carriages (13), which can move back and forth in the longitudinal direction (A) of the sheet metal plate on guides (12) in a limited work area and respectively have two or a plurality of tools, preferably plasma/laser cutter heads, stamping or drilling tools, and guide rollers (15) are associated with these carriages (13) for stops for the sheet metal plate in the longitudinal direction and retractable stops (16) for the transverse stop of the sheet metal plate, as well as collet chucks (17) for locking in the aligned sheet metal plate (1) (FIG. 1).

The roller-ball table (6) is constituted by a table (6*a*) of large surface, which adjoins the receiving side of the bending press (4), extends transversely to the run-through direction (A) of the sheet metal plate across the width of the adjoining stations (3, 7), takes up at least the length of the bending press (4) and has a plurality of spheres (6*b*) rotatably seated in it.

The welding station (7) has a welding apparatus (18) containing a plurality of welding heads (19), to which a feed device (20) is assigned, which places the reinforcement sections (2*a*) into the pre-formed sheet metal plate (1) in an aligned manner; both devices (18, 20) are adjustably seated on guides (21) in the run-through direction (A) of the sheet metal plate and are brought into their work positions in synchronicity with the sheet metal plate (1) which is cyclically transported by the trolley (8).

The pre-treatment station (9) upstream of the cutting and/or stamping station (3) is used to preform sheet metal plates (1), welding sheet metal plates (1) together into a large-surface sheet metal plate (1), for sandblasting, or the like.

As can be seen from FIGS. 2, 5 and 6, the bending press (4) has a press table (23) fixed in a C-frame (22), a hold-down device (24) movable in height and a bending cheek (27) which is pivotable in height in a guide (26) around the horizontal bevel shaft (bending shaft) (25).

The hold-down device (24) is seated in the C-frame (22) with a horizontal eccentric drive (28), pivotable in height by means of a hydraulic oscillating motor (29) and a blocking cylinder (30) which is actuated by a pressure medium.

By means of its eccentric drive (28), the hold-down device (24) can be adjusted with a small pivot stroke (H) in its pivoted-down clamping position (solid lines in FIG. 5 and dash-dotted lines in FIG. 6), in which it cooperates with the press table (23), and independently of pivot and blocking cylinders (30) which lock it in this clamping position, with bending pressure for various thicknesses (S) of sheet metal plates, and can be lifted (dash-dotted lines in FIG. 5) to release the sheet metal plate (1), and the hold-down device (24) is pivoted up into the open press position (solid lines in FIG. 6) by means of its eccentric drive (28) and the released pivot and blocking cylinder (30).

The eccentric drive (28) has an eccentric shaft (31) rotatably seated in the C-frame (22), on which a gear wheel (33), driven by a gear wheel (32) of the hydraulic oscillating motor (29) flanged on the C-frame (22), and an eccentric (34) with a rotary disk (35) and a driver (36) formed on it are seated; the hold-down device (24) is seated with a swivel bearing (37) around the eccentric (34) and is motionally connected with it, and the driver (36) of the eccentric (34) cooperates in a non-positive manner with the swivel bearing (37) for pivoting the hold-down device upward.

The pivot and blocking cylinder (30) is located above the eccentric drive (28) and is seated with its cylinder (30*a*) around a horizontal pivot shaft (38) on the C-frame (22), and hingedly engages with its piston rod (30*b*) the swivel bearing (37) of the hold-down device (24) in a horizontal pivot shaft (39) above the eccentric (34).

The bending cheek (27) is seated on two pivot segments (40), which are respectively positively guided in a crank guide (26) in the form of a roller guide extending on a circle in the C-opening (41) of the C-frame (22), are embodied as toothed quadrants and are pivotable in height via a hydraulic pivot drive (42) with drive pinions (43) .

As shown in FIG. 4, the C-frame (22) is formed by three C-stands (22*a*), connected with each other by connecting pipes (44) and the press table (23), and maintained at a distance from each other. An eccentric drive (28) with a hydraulic oscillating motor (29) is seated on each C-stand (22*a*) and all three eccentric drives (28) are motionally connected by an eccentric shaft (31) acting as a torsion shaft.

A pivot and blocking cylinder (30) is seated on each C-stand (22*a*), and the hold-down device (24) is supported via respectively a swivel bearing (37) by the eccentric drive (28) and is connected with the blocking cylinders (30). Thus, the bending press (4) has a total of three eccentric drives (28) and three pivot and blocking cylinders (30).

The bending cheek (27) can be pivoted in height by means of pivot segments (40), guided on the crank guide (26) of each C-stand (22*a*), and a central hydraulic oscillating motor (42) via a continuous torsion drive shaft (43*a*), on which the drive pinions (43) are seated, which mesh with the toothed pivot segments (40).

It is preferred to introduce into the assembly line a long bending press constituted by three or more aligned bending presses (4) which are controlled to operate synchronously and are combined into a modular component, so that it is possible to bevel even very long sheet metal plates of up to 12 m in respectively one bending step.

The long bending press (4), formed of three presses (4), is illustrated in FIGS. 1, 3 and 4.

The manipulator (5) in accordance with FIGS. 1 to 4 is constituted by a semi-portal crane, which is movable, guided on upper and lower guides (45, 46) of the bending press (4), parallel to the bending edge (25) and which has, on its cantilevered arm (47) extending transversely to the direction of movement (A) over the roller-ball table (6), a vertical gripper (49), which is movable in the longitudinal direction of the cantilevered arm (47), can itself be moved vertically and is rotatable around its vertical axis (48), for gripping the sheet metal plate (1) which is to be fed to and removed again from the bending press (4) for the individual bending steps.

The semi-portal crane (5) is supported with the lower end of its upright support column (50) on the guide (45) disposed on the bottom of the back of the C-frame (22) facing away from the C-opening (41), and is seated with its cantilevered arm (47) in the guide (46) fixed on the top of the C-frame (22); both guides (45, 46) are formed by rails (profiled section), on which the semi-portal crane (5) can be moved by means of rollers (51).

The gripper (49) has a telescoping column (52), itself movable in height, the upper end of which is supported, with the interposition of a live ring (53), on a carriage (54) which is movably suspended on a cantilevered arm (47), and which column has on its lower end a horizontal support arm (55) with two clamping chucks (56), disposed apart from each other and cooperating with the fitting marks (1*c*) of the sheet metal plate (1).

The drive for the manipulator (5) is indicated by (57) in FIG. 2, and the end switches (58) for the limitation of the travel of the manipulator (5) are shown in FIG. 4.

Furthermore, the drive (59) for the carriage (54) and the drive (60) for the live ring (53), as well as the hydraulic pump (61) assigned to them are illustrated in FIG. 2; the lift device (62), controlled by lift limiting sensors (63), is disposed in the telescoping column (52).

The oscillating motor (29) for the eccentric drive (28) and the oscillating motor (42) for the bending cheek (27) are controlled by rotation transmitters (65, 66), and the pivot and blocking cylinder (30) is embodied with a control element (sensor) (64) for locking and releasing its piston rod (30b) (FIG. 2).

The roller-ball table (6) is not shown in FIG. 2, instead the trolley (8) with its guide (11) is shown in dash-dotted lines.

The sheet metal plate (1), prepared in the pre-treatment station (9), is pulled into the cutting and/or stamping station (3) by the trolley (8) and is aligned on the guide rollers (15) and stops (16).

The two cutting and/or stamping devices (13, 14) prepare the notches (1*a*) in the corners of the sheet metal plate (1), and the openings (1*b*) and the reamed holes (1*c*) by means of plasma— or $CO_2$-laser cutting or by stamping and/or drilling.

In the process, the trolley (8) fixes the aligned sheet metal plate (1) by means of the chucks (17) and the two devices operate in a limited work area (X, Y), and the sheet metal plate (1) is moved on in steps (clocked movements) by the trolleys (8) after each work area (X, Y) until the entire length of the sheet metal plate has been worked.

Retaining bolts are inserted into the reamed holes (1*c*) and welded in.

Then the sheet metal plate (1) is transported on the roller-ball table (6).

The formed sheet metal plate (1) is now taken over by the manipulator (5), which services the bending press (4), for the individual bending steps. For this purpose the gripper (49) moves downward on the sheet metal plate (1) and its clamping chucks (56) grip the fitting marks (1*c*), and then the sheet metal plate (1) is inserted into the opened bending press (4) for performing the first bending step while maintaining its seat on the roller-ball table (6).

Because the manipulator (5) can move the sheet metal plate (1) in the plane of the sheet metal plate by means of the semiportal crane and the gripper carriage (54), and can turn it by means of the live ring (53), the sheet metal plate (1) is displaced inside the bending press (4) for each new bending step and, for making a new profiled edge section (1*d*), is taken out of the bending press (4), placed into the new position and returned into the bending press (4) again, the manipulator (5) always grasping the sheet metal plate (1) by its fitting marks (1*c*).

The travel distance (MW) of the manipulator (5) extends over nearly the entire length of the bending press (4).

To perform each bending step for the profiled edge section (1*d*) of the sheet metal plate (1), the hold-down device (24) is pivoted down, firmly clamps the sheet metal plate (1) between itself and the press table (23) and then the bending cheek (27) is pivoted upward in a controlled manner.

Afterwards the bending cheek (27) is pivoted back downward and the hold-down device (24) is lifted, so that the sheet metal plate (1) can be prepared in the press (4) for the subsequent bending step, and displaced.

When the profiled section (1*d*) has been finished on the one side of the plate, the manipulator (5) takes the sheet metal plate (1) out of the bending press (4), turns the sheet metal plate (1) around and again inserts it into the bending press (4) for bending the profiled section on the next side of the sheet metal plate, in the course of which the same bending steps are repeated.

During each bending step the eccentric drive (28) keeps the pivoted-down hold-down device (24) under great pressure against the sheet metal plate (1) lying on the press table (23). In the process, the pivot and blocking cylinder (30) is extended and locked (FIG. 5).

The eccentric drive (28) is actuated by its oscillating motor (29) for lifting the hold-down device (24), i.e. for releasing the sheet metal plate (1) so it can be displaced in the C-opening (41) for the subsequent bending step; in the process, the gear wheel (32) turns the eccentric shaft (31) via the gear wheel (33) and thus also the eccentric (34), and the pivot and blocking cylinder (30) remains locked in its extended position during this.

Now, because of the rotation of the eccentric (34), the hold-down device (24) is positively lifted by its swivel bearing (37) seated around the eccentric (34) and is slightly lifted off the sheet metal plate (1) over a short lift-pivot path (H)—in the course of this the hold-down foot (24*a*) of the hold-down device (24) moves away from the bending edge (25) on a movement path which is directed obliquely upward and outward—at an inclination of approximately 45°—into the hold-down position shown by dash-dotted lines in FIG. 5, and the sheet metal plate (1) is released for displacement.

The short lift-pivot path of the hold-down device (24) is made possible by the hinged connection (29) with the pivot and blocking cylinder (30), in spite of its being locked.

The eccentric (34) is turned in the opposite direction for renewed clamping of the sheet metal plate (1) and in this way the hold-down device (24) is again pressed against the sheet metal plate (1).

This lift-pivot path (H) of the hold-down device (24) at the same time makes possible the compensation for different thicknesses of sheet metal plates of approximately 4 to 10 mm, so that by means of the eccentric (34) the hold-down device (24) exerts the same high pressure on each sheet metal thickness within the above mentioned thickness range.

With thinner or thicker sheet metal, the rotation of the eccentric (34) takes place at a smaller or larger angle of rotation and in this way the adaptation of the hold-down device (24) to the respective sheet metal thickness.

The pivot and blocking cylinder (30) is released for opening the bending press (4) and the eccentric drive (28) is turned further and, when its driver (36) pushes against the swivel bearing (37), the hold-down device (24) is pivoted upward.

The released cylinder (30) is retracted at the same time and supports the upward pivot movement of the hold-down device (24).

Based on the continuous eccentric shaft (31) and the disposition of three eccentric drives (28) of each bending press (4), which has a length of approximately 4 m, the parallel pivoting of the hold-down device (24) is assured, even in connection with short bending ranges wherein the hold-down device (24) acts on the sheet metal plate (1) only with a portion of its length; thus, no one-sided load on the hold-down device (24) is created. This also applies in connection with the long bending press (4) formed by three presses (4).

Beveling of the profiled edge sections (1*d*) on all four sides of the sheet metal plate (1) is made possible by the notches (1*a*) in the corners.

After all bending processes have been completed, the manipulator (5) removes the formed sheet metal plate (1) and transfers it to the second trolley (8), which transports it to the welding station (7).

The trolley (8) moves the sheet metal plate (1), which is fixed in its position, in steps through this station (7), in which the feed device (20) inserts the reinforcement sections (2*a*) into the sheet metal plate (1) aligned at distances to form a grid, and then the welding device (18) welds the sections (2*a*) to the sheet metal plate (1) by means of its controllable welding heads (19).

Subsequently the finished steel coffer (2) is moved out of the welding station (7) by the trolley (8) onto the roller conveyor (10) to be moved away and the fabrication process is finished.

The finished steel coffer (2) constitutes a coffer element in a box shape having a wall (2*b*) which itself is flat and a circumferential, multiply beveled profiled edge section (1*d*), and which has, beneath its flat wall (2*b*), the reinforcement sections (2*a*) fastened there, has the openings (1*b*) and connecting holes (1*b*) in the circumferential profiled edge section (1*d*), and in the corners has notches (1*a*) for beveling the profiled edge sections (1*d*) and for inserting supports, while being provided with fitting marks (1*c*) in the form of holes or bolts in its flat wall (2*b*).

What is claimed is:

1. An assembly line for producing a steel coffer for ceilings and/or wall structures from a sheet metal plate, characterized in that disposed successively in the run-through direction (A) of the sheet metal plate are a. a cyclically-operating cutting and/or stamping station (3), which places notches (1*a*), openings (1*b*) and fitting marks (1*c*) into the sheet metal plate (1), b. a bending press (4), forming the sheet metal plate (1) into a singly- or multiply-beveled profiled section (1*d*) in steps, with c. an associated roller-ball table (6) as a support for the sheet metal plate, and with d. an associated manipulator (5), which grasps the sheet metal plate (1) at the fitting marks (1*c*) in the form of reamed holes and/or retaining bolts, moves the sheet metal plate (1) in and transversely to the run-through direction (A) of the sheet metal plate in the plane of the sheet metal plate and rotates it around a vertical axis (48) in the plane of the sheet metal plate, inserts the sheet metal plate (1) into the bending press (4) for the individual forming steps and removes it again, and e. a welding station (7), which cyclically welds reinforcement sections (2*a*) at distances to form a grid into the formed sheet metal plate (1), and that f. at least one trolley (8) is disposed underneath the cutting and/or stamping station (3), the roller-ball table (6) and the welding station (7), which transports the sheet metal plate (1) in a straight line from one to the other station (3 to 7), and, while stopped, maintains the sheet metal plate (1) fixed in its position for the working steps in the cutting and/or stamping machine (3) and in the welding station (7), moves it in steps.

2. An assembly line in accordance with claim 1, characterized in that the cutting and/or stamping station (3) has two carriages (13), which can move back and forth in the longitudinal direction (A) of the sheet metal plate on guides (12) in a limited work area (X, Y) and respectively having two or a plurality of tools (14), and that guide rollers (15) on the long sides are associated with this carriage (13) for stops for the sheet metal plate in the longitudinal direction and retractable stops (16) on the transverse sides for the transverse stop of the sheet metal plate, as well as collet chucks (17) for locking in the aligned sheet metal plate (1).

3. An assembly line in accordance with claim 1, characterized in that the roller-ball table (6) is constituted by a table (6*a*) of large surface, which adjoins the receiving side of the bending press (4), extends transversely to the run-through direction (A) of the sheet metal plate across the width of the adjoining stations (3, 7), takes up at least the length of the bending press (4) and has a plurality of spheres (6*b*) rotatably seated in it.

4. An assembly line in accordance with claim 1, characterized in that the welding station (7) has a welding apparatus (18) containing a plurality of welding heads (19), and a feed device (20), which places the reinforcement sections (2*a*) to be welded into the pre-formed sheet metal plate (1) in an aligned manner, that both devices (18, 20) are adjustably seated on guides (21) in the run-through direction (A) of the sheet metal plate and can be brought into their work positions in synchronicity with the sheet metal plate (1) which is cyclically transported by the trolley (8).

5. An assembly line in accordance with claim 1, characterized in that a pre-treatment station (9) is placed upstream of the cutting and/or stamping station (3) to preform sheet metal plates, to weld sheet metal plates together into a large-surface sheet metal plate (1), for sandblasting, or the like, and that a roller conveyor (10), which moves the finished steel coffer (2) away, is placed downstream of the welding station (7).

6. An assembly line in accordance with claim 1, characterized in that two trolleys (8) in the form of underfloor trolleys, which can be moved on a guide (11), are disposed under the stations (3 to 10), wherein the movement path (FW1) of first trolley (8) extends from the pre-treatment station (9) to the center of the roller-ball table (6), and the movement path (FW2) of the second trolley (8) extends from the center of the roller-ball table (6) into the area of the roller conveyor (10).

7. An assembly line with a bending press in accordance with claim 1, the bending press (4) having a press table (23) fixed in a C-frame (22), a hold-down device (24) movable in height and a bending cheek (27) which is pivotable in height in a guide (26) around the horizontal bevel shaft (bending shaft 25).

characterized in that the hold-down device (24) is seated in the C-frame (22) with a horizontal eccentric drive (28), pivotable in height by means of a hydraulic oscillating motor (29) and a pivoting and blocking cylinder (30) which is actuated by a pressure medium, and that by means of its eccentric drive (28), the hold-down device (24) can be adjusted with a small pivot stroke (H) in its pivoted-down clamping position, in which it cooperates with the press table (23), and independently of pivot and blocking cylinders (30) which lock it in this clamping position, with bending pressure for various thicknesses (S) of sheet metal plates, and can be lifted to release the sheet metal plate (1), and that the hold-down device (24) can be pivoted up into the open press position by means of its eccentric drive (28) and the released pivot and blocking cylinder (30).

8. A bending press in accordance with claim 7, characterized in that the eccentric drive (28) has an eccentric shaft (31) rotatably seated in the C-frame (22), on which a gear wheel (33), driven by a gear wheel (32) of the hydraulic oscillating motor (29) flanged on the C-frame (22), and an eccentric (34) with a rotary disk (35) and a driver (36) formed on it are seated, and that the hold-down device (24) is seated with a swivel bearing (37) around the eccentric (34) and is motionally connected with it, and the driver (36) of the eccentric (34) cooperates in a non-positive manner with the swivel bearing (37) for pivoting the hold-down device upward.

9. A bending press in accordance with claim 8, characterized in that the pivot and blocking cylinder (30) is located above the eccentric drive (28) on the C-frame (22) and is seated with its cylinder (30*a*) around a horizontal pivot shaft (38), and hingedly engages with its piston rod (30*b*) the swivel bearing (37) of the hold-down device (24) in a horizontal pivot shaft (39) above the eccentric (34).

10. A bending press in accordance with claim 7, characterized in that the bending bar (27) is seated on two pivot segments (40), which are respectively positively guided in a crank guide (26) in the form of a roller guide extending on a circle in the C-opening (41) of the C-frame (22), are embodied as toothed quadrants and are pivotable in height via a hydraulic pivot drive (42) with drive pinions (43).

11. A bending press in accordance with claim 7, characterized in that the C-frame (22) is formed by three C-stands (22*a*), connected with each other by connecting pipes (44) and the press table (23) and maintained at a distance from each other, that an eccentric drive (28) with a hydraulic oscillating motor (29) is seated on each C-stand (22*a*) and that all three eccentric drives (28) are motionally connected by an eccentric shaft (31) acting as a torsion shaft, and that a blocking cylinder (30) is seated on each C-stand (22), and that the hold-down device (24) is supported via respectively a swivel bearing (37) by the eccentric drive (28) and is connected with the blocking cylinders (30).

12. A bending press in accordance with claim 7, characterized in that the bending cheek (27) can be pivoted in height by means of pivot segments (40), guided on the crank guide (26) of each C-stand (22*a*), and a central hydraulic oscillating motor (42) via a continuous torsion drive shaft (43*a*), on which drive pinions (43) are seated, which mesh with the toothed pivot segments (40).

13. An assembly line in accordance with claim 1 , characterized in that therein is disposed a long bending press (4) constituted of three or more aligned bending presses (4) which are controlled to operate synchronously and are combined into a modular component.

14. An assembly line with a bending press and a manipulator associated with it in accordance with claim 1, characterized in that the manipulator (5) is constituted by a semi-portal crane (5), which is movable, guided on upper and lower guides (45, 46) of the bending press (4), parallel to the bending edge (25), which has, on its cantilevered arm (47) extending transversely to the direction of movement (A) over the roller-ball table (6), a vertical gripper (49), which is movable in the longitudinal direction of the cantilevered arm (47), can itself be moved vertically and is rotatable around its vertical axis (48), for gripping the sheet metal plate (1) which is to be fed to and removed again from the bending press (4) for the individual bending steps.

15. A manipulator in accordance with claim 14, characterized in that the semi-portal crane (5) is supported with the lower end of its upright support column (50) on the guide (45) disposed on the bottom of the back of the C-frame (22) facing away from the C-opening (41), and is seated with its cantilevered arm (47) in the guide (46) fixed on the top of the C-frame (22), and that both guides (45, 46) are formed by rails (profiled sections), on which the semi-portal crane (5) can be moved by means of rollers (51).

16. A manipulator in accordance with claim 15, characterized in that the gripper (49) has a telescoping column (52), itself movable in height, with a lifting device (62) disposed therein, the upper end of which is supported, with the interposition of a live ring (53), on a carriage (54) which is movably suspended on a cantilevered arm (47), and which has on its lower end a horizontal support arm (55) with two clamping chucks (56), disposed apart from each other and cooperating with the fitting marks (1*c*) of the sheet metal plate (1).

17. An assembly line in accordance with claim 2 characterized in that a pre-treatment station (9) is placed upstream of the cutting and/or stamping station (3) to preform sheet metal plates, to weld sheet metal plates together into a large-surface sheet metal plate (1), for sandblasting, or the like, and that a roller conveyer (10), which moves the finished steel coffer (2) away, is placed downstream of the welding station.

18. An assembly line in accordance with claim 17 characterized in that two trolleys (8) in the form of underfloor trolleys, which can be moved on a guide (11), are disposed under the stations (3 to 10), wherein the movement path (FW1) of first trolley (8) extends from the pre-treatment station (9) to the center of the roller-ball table (6), and the movement path (FW2) of the second trolley (8) extends from the center of the roller-ball table (6) into the area of the roller conveyer (10).

19. An assembly line in accordance with claim 18, characterized in that therein is disposed a long bending press (4) constituted of three or more aligned bending presses (4) which are controlled to operate synchronously and are combined into a modular component.

20. A bending press in accordance with claim 11, characterized in that the bending cheek (27) can be pivoted in height by means of pivot segments (40), guided on the crank guide (26) of each C-stand (22*a*), and a central hydraulic oscillating motor (42) via a continuous torsion drive shaft (43*a*), on which drive pinions (43) are seated, which mesh with the toothed pivot segments (40).

21. The assembly line according to claim 2, wherein the tools (4) includes selectively plasma/laser cutter heads, stamping tools, and drilling tools.

* * * * *